US011137700B1

(12) United States Patent
Huang

(10) Patent No.: US 11,137,700 B1
(45) Date of Patent: Oct. 5, 2021

(54) TONER CARTRIDGE

(71) Applicant: GENERAL PLASTIC INDUSTRIAL CO., LTD., Taichung (TW)

(72) Inventor: Ching-Ho Huang, Taichung (TW)

(73) Assignee: GENERAL PLASTIC INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 16/827,060

(22) Filed: Mar. 23, 2020

(51) Int. Cl.
*G03G 15/08* (2006.01)
*G03G 21/16* (2006.01)

(52) U.S. Cl.
CPC ..... *G03G 15/0881* (2013.01); *G03G 21/1647* (2013.01); *G03G 21/1676* (2013.01)

(58) Field of Classification Search
CPC ..... G03G 21/1814; G03G 21/1647; G03G 21/1676; G03G 21/1619; G03G 15/0881
See application file for complete search history.

(56) References Cited

U.S. PATENT DOCUMENTS

2010/0178080 A1* 7/2010 Huang ..... G03G 15/0886 399/262
2011/0052266 A1* 3/2011 Yoon ..... G03G 21/18 399/258
2014/0356016 A1* 12/2014 Buchanan ..... G03G 15/0875 399/98
2015/0168870 A1* 6/2015 Martin ..... G03G 15/0877 399/262
2015/0268582 A1* 9/2015 Funada ..... G03G 15/0865 399/258
2017/0357207 A1* 12/2017 Nagashima ..... G03G 15/0865
2018/0356750 A1* 12/2018 Huang ..... G03G 15/0865

* cited by examiner

*Primary Examiner* — Walter L Lindsay, Jr.
*Assistant Examiner* — Jessica L Eley
(74) *Attorney, Agent, or Firm* — Muncy, Geissler, Olds & Lowe, P.C.

(57) ABSTRACT

A toner cartridge is adapted for being connected with an image-forming cartridge of an electronic image-forming, which includes a toner inlet and a step portion located by the toner inlet. The toner cartridge includes a housing having an internal accommodation for storage of toners, a toner outlet communicated with the internal accommodation and an outside of the housing, and a position-limiting hook located by the toner outlet. When the toner cartridge is connected with the image-forming cartridge, the position-limiting hook is engaged with the step portion such that the toner outlet is communicated with the toner inlet. As such, the toner cartridge can be positively positioned with the image-forming cartridge, and the toner outlet can be positively sealed to avoid toner leaking before installation and after dismantlement of the toner cartridge.

11 Claims, 8 Drawing Sheets

TONER CARTRIDGE

BACKGROUND OF THE INVENTION

1. Field of the Invention

The present invention relates generally to an electronic image-forming apparatus and more particularly, to a toner cartridge for being used in an electronic image-forming apparatus.

2. Description of the Related Art

A conventional electronic image-forming apparatus, such as photocopier or printer, is equipped with an image-forming cartridge having a photosensitive drum, and a toner cartridge connected with the image-forming cartridge. The image-forming cartridge is provided with a toner inlet. The toner cartridge is adapted for supplying toners to the image-forming cartridge to enable operation of the image-forming cartridge. The conventional toner cartridge has a housing, a toner outlet provided at the housing and communicated with the toner inlet, a switch moveably disposed on the housing, a foamed sponge mounted to the switch, and a spring disposed between the housing and the switch. The switch is moveable relative to the housing between a closed position where the switch seals the toner outlet with the assistance of the foamed sponge, and an open position where the switch does not seal the toner outlet. The spring imparts a biasing force exerting on the switch toward the closed position. However, if the toner cartridge is inaccurately positioned to result in that an exceeding gap exists between the toner outlet and the toner inlet when the toner cartridge is assembled with the image-forming cartridge, a problem of leaking toners may easily occur.

In another aspect, the thickness of the foamed sponge and the spring are the potential factors that may cause toner leaking. If the foamed sponge is too thin, the toner outlet may not be positively sealed. If the foamed sponge is too thick, the switch may be hardly pushed to move to a correct position when the toner cartridge is installed with the image-forming cartridge. Further, the switch may be returned to an inaccurate position due to fatigue of elasticity of the spring, resulting in that the switch may not seal the toner outlet properly. These leaking problems cause not only the waste of toners but also toner contamination to the whole apparatus. Therefore, how to ensure that the toner cartridge can be positively and accurately positioned when it is assembled with the image-forming cartridge and to avoid toner leaking before installation and after dismantlement of the toner cartridge are issues that the manufacturers in this industry field need to solve.

SUMMARY OF THE INVENTION

The present invention has been accomplished in view of the above-noted circumstances. It is an objective of the present invention to provide a toner cartridge, which can be positively positioned in desired position after it is connected to an image-forming cartridge.

It is another objective of the present invention to provide a toner cartridge, the toner outlet of which can be positively sealed to avoid toner leaking before installation and after dismantlement of the toner cartridge.

To attain the above-mentioned objectives, the present invention provides a toner cartridge for being connected with an image-forming cartridge of an electronic image-forming apparatus. The image-forming cartridge comprises a toner inlet and a step portion located by the toner inlet. The toner cartridge comprises a housing having an internal accommodation for storage of toners, a toner outlet communicated with the internal accommodation and an outside of the housing, and a position-limiting hook located by the toner outlet. When the toner cartridge is connected with the image-forming cartridge, the position-limiting hook is engaged with the step portion such that the toner outlet is communicated with the toner inlet. As a result, the toner cartridge can be positively positioned with the image-forming cartridge, and the toner outlet can be positively sealed to avoid the problem of toner leaking before installation and after dismantlement of the toner cartridge.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
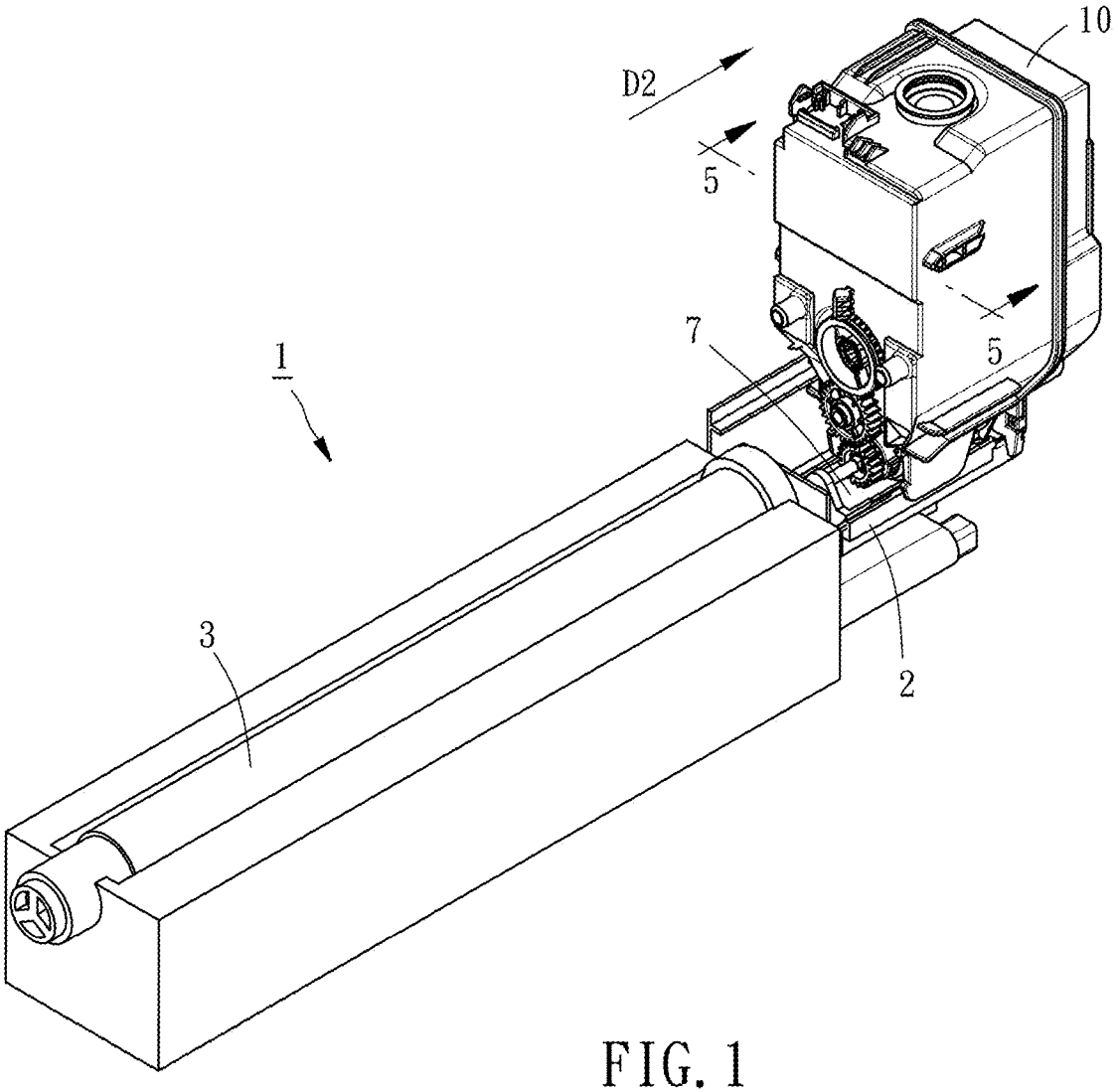
FIG. 1 is a perspective view of a toner cartridge according to an embodiment of the present invention, which is connected with an image-forming cartridge.
Figure 2A:
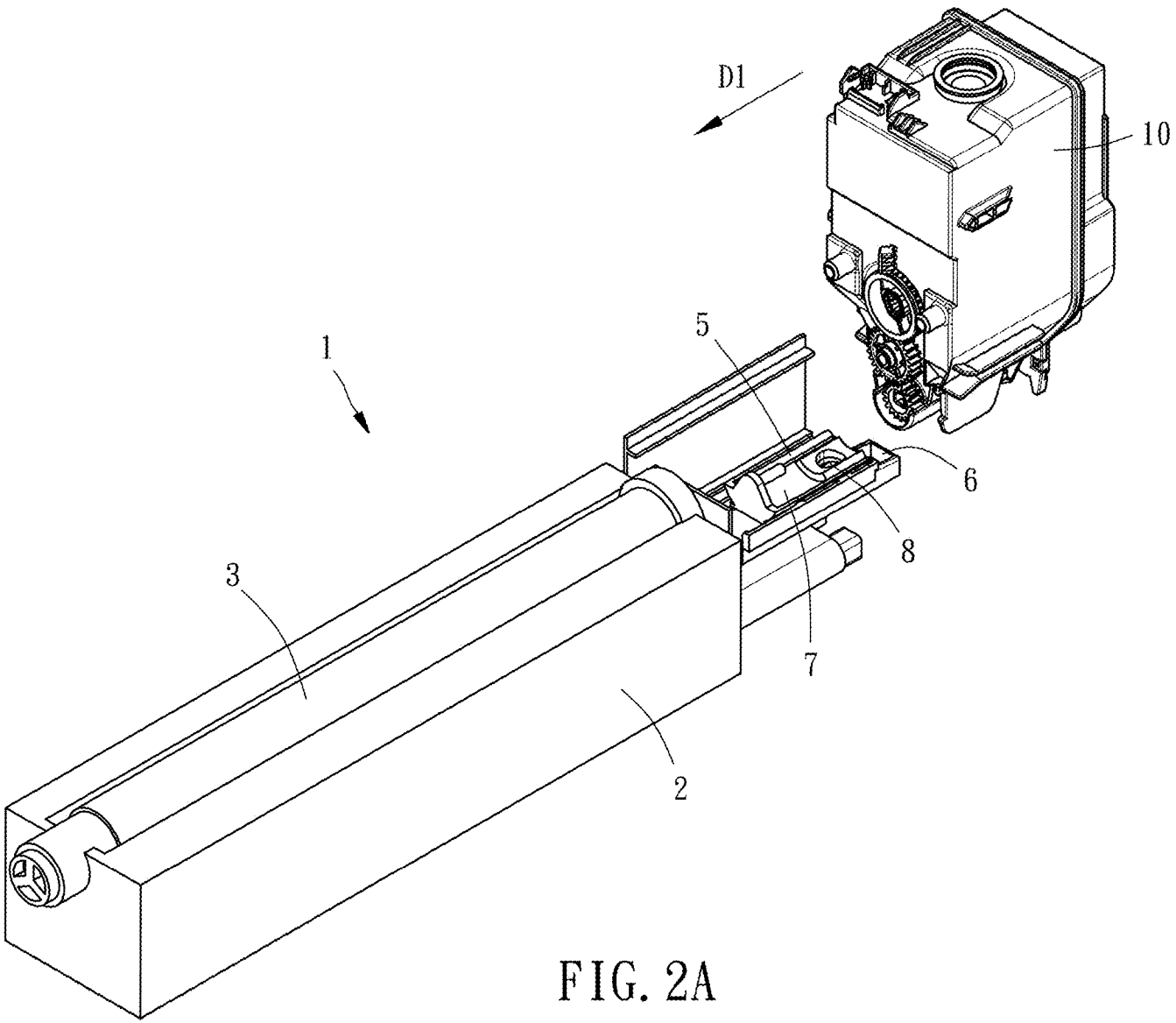
FIG. 2A is a schematic perspective view showing that the toner cartridge of the embodiment of the present invention is dismantled from the image-forming cartridge.
Figure 2B:
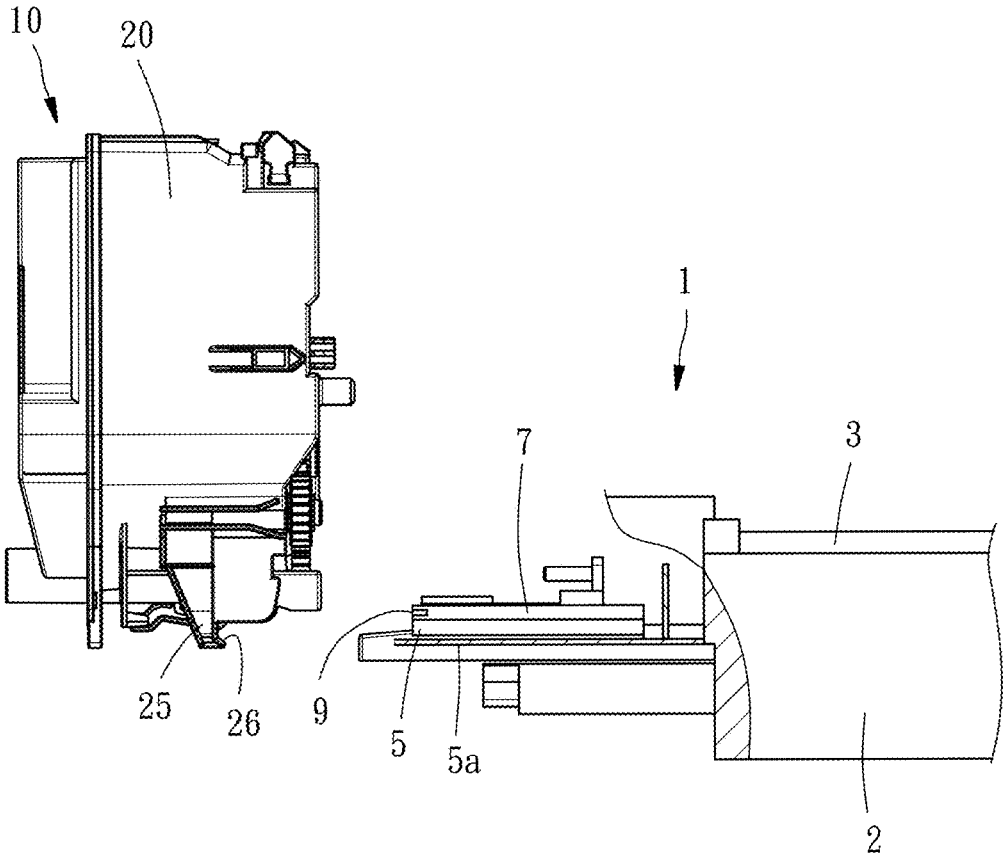
FIG. 2B is a schematic partially cutaway lateral side view showing that the toner cartridge of the embodiment of the present invention is dismantled from the image-forming cartridge.
Figure 5:
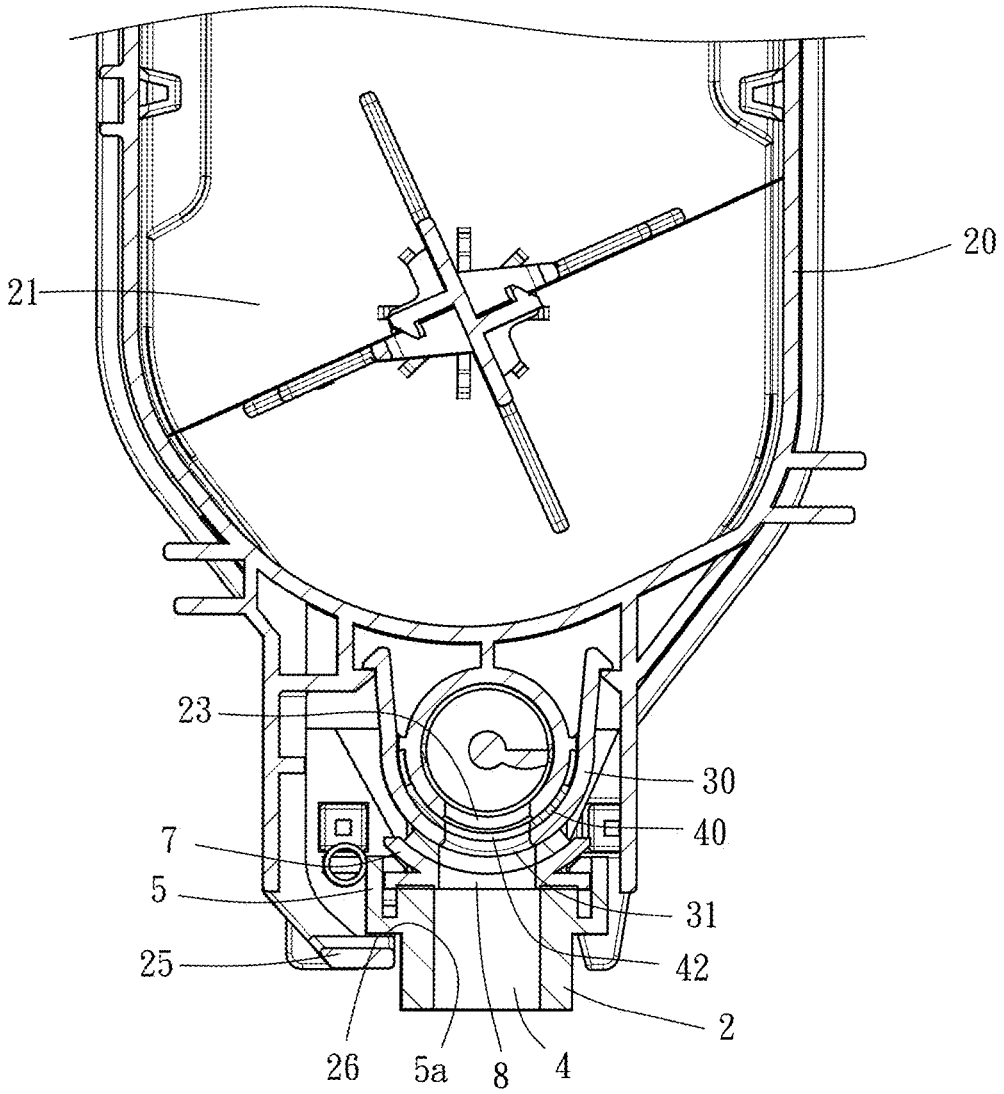
FIG. 5 is a partially sectional view taken along line 5-5 of FIG. 1.
Figure 6:
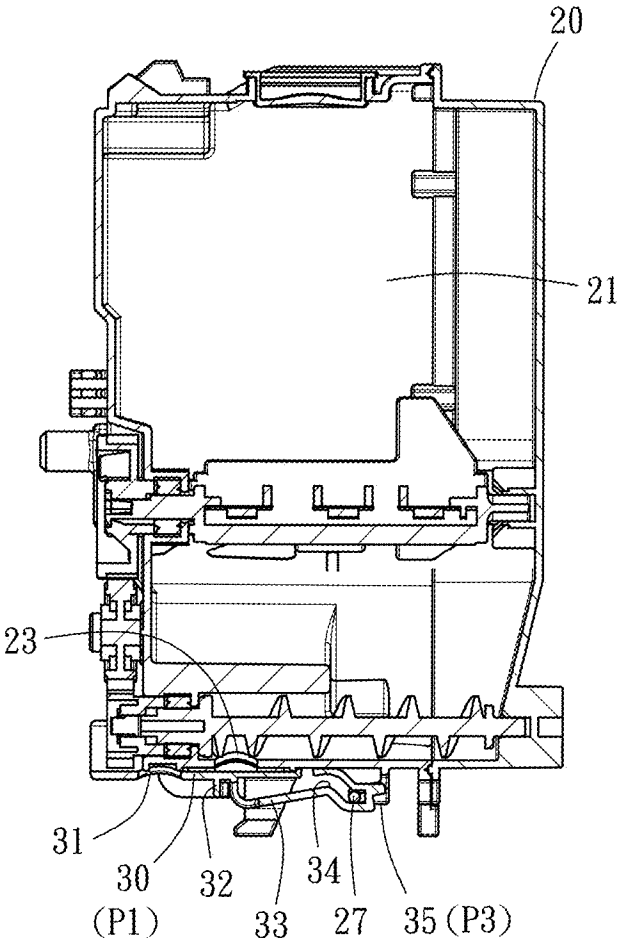
FIG. 6 is a schematic view showing the toner cartridge is to be installed with the image-forming cartridge or the toner cartridge is dismantled from the image-forming cartridge.
Figure 6:
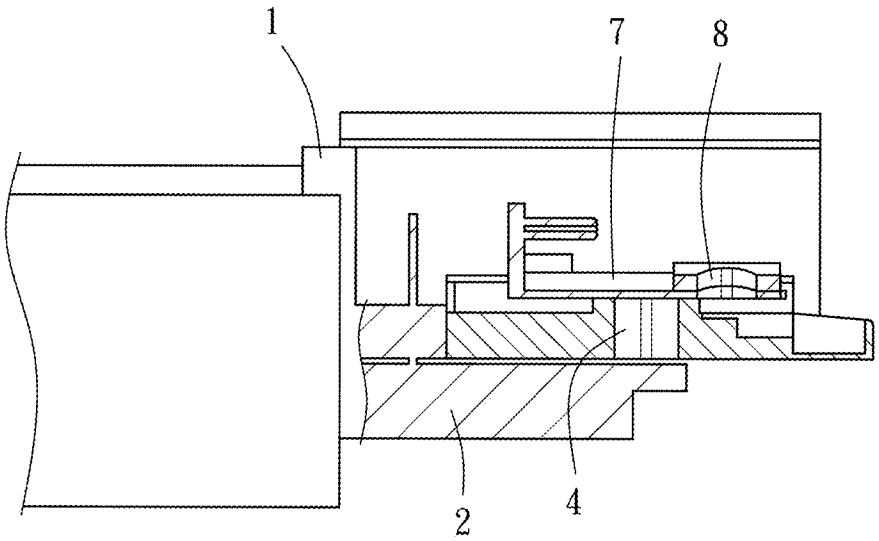
Figure 7:
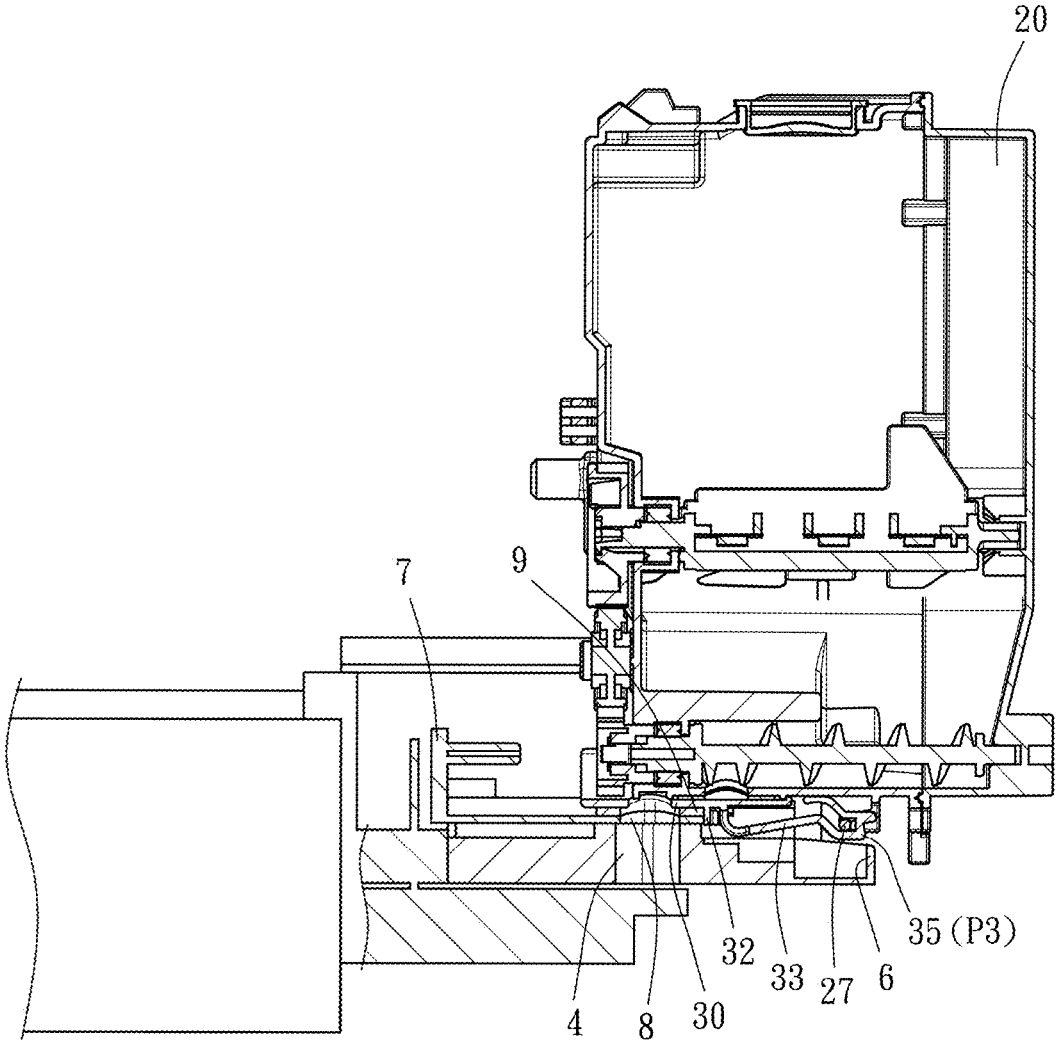
FIG. 7 is s a schematic view showing the toner cartridge is installed with the image-forming cartridge and an upper slider is located at a closed position.
Figure 8:
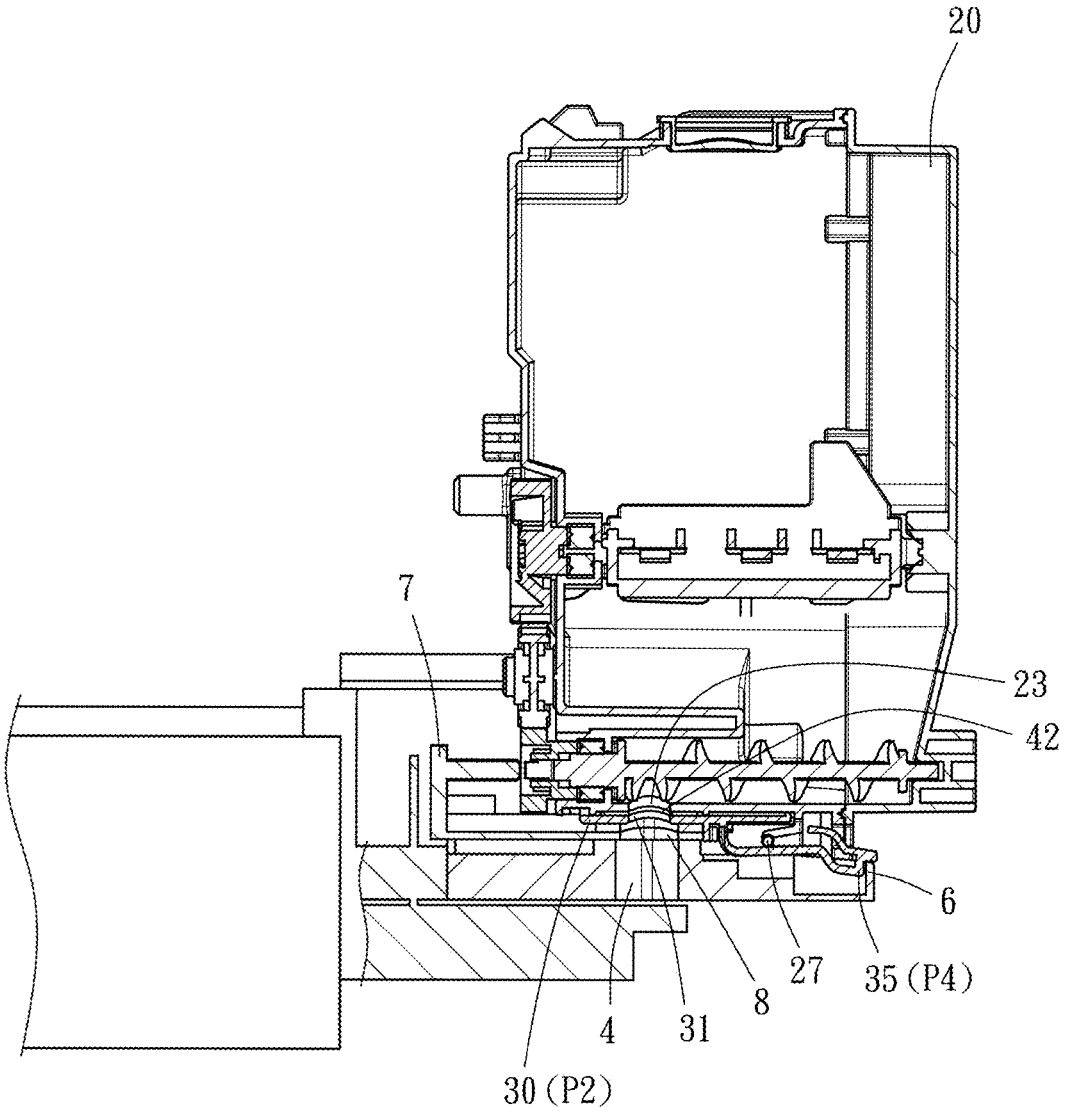
FIG. 8 is s a schematic view showing the toner cartridge is installed with the image-forming cartridge and the upper slider is located at an open position.

Hereunder one embodiment will be detailedly described with accompanying drawings for illustrating technical features and structure of the present invention. FIG. 1 is a perspective view showing a toner cartridge 10 in accordance with a preferred embodiment of the present invention is installed to an image-forming cartridge 1. The image-forming cartridge 1 is adapted to be installed in an electronic image-forming apparatus (not shown), such as photocopies, printer, etc. As shown in FIGS. 2A and 2B, the image-forming cartridge 1 comprises a main body 2, a photosensitive drum 3 mounted to the main body 2, a lower slider 7 moveably mounted on the main body 2, and a resilient member (not shown) disposed between the main body 2 and the lower slider 7. It is to be mentioned that in this embodiment, an installation direction D1 is defined as a direction parallel to an axis of the photosensitive drum 2 and approaching toward the image-forming cartridge 1, as shown in FIG. 2A, and a dismantlement direction D2 is defined as a direction reverse to the installation direction D1, as shown in FIG. 1. The main body 2 is provided at a distal end thereof with an abutment portion 6. The main body 2 further comprises a toner inlet 4 having an opening facing upwardly, as shown in FIGS. 6-8, and a step portion 5 located by the toner inlet 4, as shown in FIGS. 2A and 5, such that toners can enter into an inside of the main body 2 via the toner inlet 4 for enabling image formation of the photosensitive drum 3. The step portion 5 has a step surface 5*a* facing downwardly. The lower slider 7 has a through hole 8 and a first stop portion 9 located by the through hole 8. In this embodiment, the stop portion 9 is formed at an end of the lower slider 7, and the resilient member (not shown) imparts a biasing force exerting on the lower slider 7 toward the dismantlement direction D2, such that the lower slider 7 can seal the toner inlet 4 when the lower slider 7 is forced by the biasing force of the resilient member to move to a predetermined position. In contrast, when the lower slider 7 receives an external force that overcomes the biasing force of the resilient member to move toward the installation direction D1 to another predetermined position, the through hole 8 is aimed at the toner inlet 4.

Figure 3:
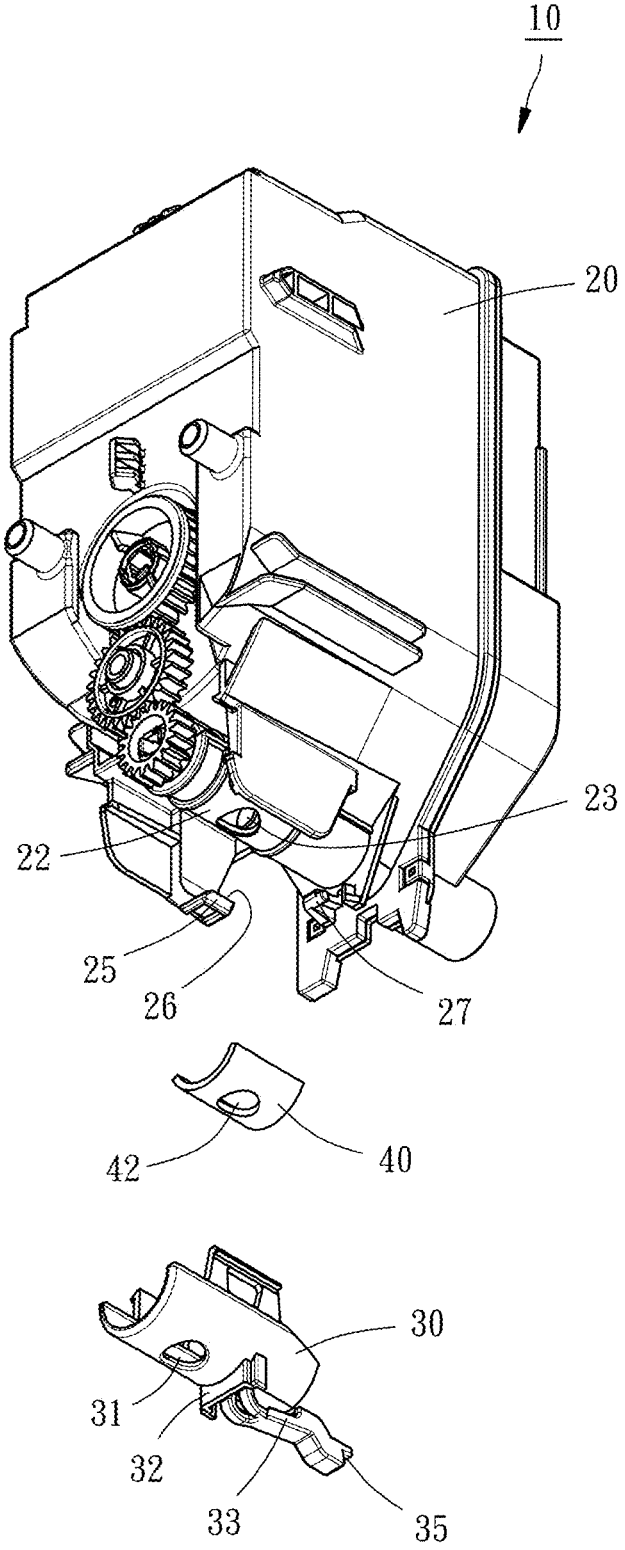
FIG. 3 is an exploded perspective view of the toner cartridge of the embodiment of the present invention.

As shown in FIG. 3, the toner cartridge 10 comprises a housing 20, an upper slider 30, and a seal member 40.

Referring to FIGS. 3 and 6, the housing 20 includes an internal accommodation 21 for storage of toners, a toner outlet 23 communicated with the internal accommodation 21 and an outside of the housing 20, a position-limiting hook 25 located by the toner outlet 23, and a guiding portion 27 provided by the toner outlet 23. In this embodiment, the toner outlet 23 is provided at a bottom side 22 of the housing 20, and the position-limiting hook 25 extends downwardly from a side of the toner outlet 23 and has a terminal end with a hook surface 26 facing upwardly. The guiding portion 27 is realized as a protrusion rod substantially extending horizontally.

Figure 4:
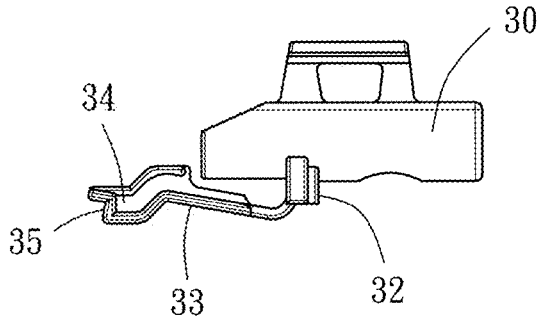
FIG. 4 is a lateral side view of an upper slider of the toner cartridge of the embodiment of the present invention.

Referring to FIG. 4, the upper slider 30 is disposed on the bottom side 22 of the housing 20 in a way that the upper slider 30 is moveable relative to the housing 20 between a closed position P1, as shown in FIG. 6, and an open position P2, as shown in FIG. 8. The upper slider 30 has an opening 31, a second stop portion 32 located by the opening 31, and a resilient arm 33 located behind the second stop portion 32. The resilient arm 33 includes a guiding groove 34 and a terminal end 35. The guiding groove 34 is provided at a lateral side of the resilient arm 33, and the guiding portion 27 of the housing is inserted into the guiding groove 34. The terminal end 35 is downwardly moveable from an initial position P3, as shown in FIG. 6, to an engagement position P4, as shown in FIG. 8, located below the initial position P3. When the upper slider 30 is located at the closed position P, the upper slider 30 seals the toner outlet 23. When the upper slider 30 is located the open position P2, the opening 31 is aimed at the toner outlet 23 of the housing 20, such that the upper slider 30 does not seal the toner outlet 23.

The seal member 40 is disposed between the upper slider 30 and the housing 20, and has a though hole 42 corresponding in location to the toner outlet 23. In this embodiment, the seal member 40 is realized as a foamed sponge and fixed to the housing 20. The seal member 40 is compressed by the upper slider 30 to slightly deform, thereby providing good sealing effect.

When the toner cartridge 10 has not been connected with the image-forming cartridge 1, the upper slider 30 of the toner cartridge 10 is located at the closed position P1, as shown in FIGS. 2 and 6. At this status, the opening 31 is misalignment in position with the toner outlet 23, such that the toner outlet 23 is sealed by the upper slider 30 and the seal member 40. Further, the lower slider 7 also seals the toner inlet 4. In the process that the toner cartridge 10 moves along the installation direction D1 to connect the image-forming cartridge 1, the position-limiting hook 25 is engaged with the step portion 5 in a way that the hook surface 26 is abutted against the step surface 5*a*, as shown in FIGS. 5 and 7, and the second stop portion 32 will pushes the first stop portion 9 to overcome the biasing force of the resilient member, which exerts on the lower slider 7, to drive the lower slider 7 to move relative to the main body 2 in the installation direction D1 until the lower slider 7 is stopped by the main body 2. At this status, the through hole 8 of the lower slider 7 is just aimed at the toner inlet 4, and the opening 31 of the upper slider 30 is aimed at the through hole 8 of the lower slider 7, as shown in FIG. 7.

When the toner cartridge 10 continuously moves in the installation direction D1, the upper slider 30 cannot move relative to the lower slider 7 because the second stop portion 32 is stopped by the first stop portion 9, but can move relative to the housing 20 from the closed position P1 to the open position P2. In other words, the housing 20 continuously moves relative to the upper slider 30 in the installation direction D1. When the upper slider 30 is located at the open position P2, the opening 31 is aimed at the toner outlet 23, such that the toner outlet 23 is communicated with the toner inlet 4 to enable the toners contained inside the housing 20 to enter into the image-forming cartridge 1. In the process that the upper slider 30 slidably moves relative to the housing 20, the guiding groove 34 is guided by the guiding portion 27 in such a way that the terminal end 35 of the resilient arm 33 moves downwardly from the initial position P3 to the engagement position P4 where the terminal end 35 of the resilient arm 33 is abutted against the abutment portion 6, as shown in FIGS. 1 and 8.

When the toner cartridge 10 runs out of toner and the user dismantles the empty toner cartridge 10 along the dismantlement direction D2 from the image-forming cartridge 1, because the terminal end 35 of the resilient arm 33 is stopped by the abutment portion 6, as shown in FIG. 8, the upper slider 30 cannot move along with the housing 20, such that the upper slider 30 is moved relative to the housing 20 from the open position P2 to the closed position P1. In other words, the housing 20 moves relative to the upper slider 30 in the dismantlement direction D2. With the aforesaid structural features, even if the friction force between the upper slider 30 and the seal member 40 is great due to the grounds that the seal member 40 has a thicker thickness or a deformation of warpage, the upper slider 30 can still be positively and accurately moved to the closed position P1, thereby avoid the problem that the spring of the conventional structure cannot position the switch accurately. Until the resilient arm 33, which is guided by the guiding portion 27, is upwardly moved from the engagement position P4 to the initial position P3, the upper slider 30 can move along with the housing 20 to escape from the image-forming cartridge 1. As soon as the housing 20 is departed from the image-forming cartridge 1, the lower slider 7 will return to its initial position due to the biasing force of the resilient member to seal the toner intel 4 again, as shown in FIG. 6, thereby completing the whole dismantlement proceeding of the toner cartridge.

Since the position-limiting hook 25 of the toner cartridge 10 is engaged with the step portion 5 of the image-forming cartridge 1 when the toner cartridge 10 is connected with the image-forming cartridge 1, the toner cartridge 10 can not only be accurately and positively positioned with the image-forming cartridge 1 but also be firmly connected with the image-forming cartridge 1 so as to minimize the gap between the toner outlet 23 and the toner inlet 4, thereby ensuring that the toner cartridge 10 can be installed in the image-forming cartridge 1 without the problem of toner leaking. In another aspect, when the toner cartridge 10 is dismantled, the toner cartridge 10 will be able to be taken out of the image-forming cartridge 1 after the upper slider 30 has positively sealed the toner outlet 23. As a result, the problem of toner leaking can be avoided before or after the toner cartridge 10 is installed with the image-forming cartridge 1 or after the toner cartridge 10 is dismantled from the image-forming cartridge 1, thereby achieving the objectives of the present invention.

It is to be mentioned that the structure of the image-forming cartridge 1 is not the primary feature of the present invention as long as the image-forming cartridge 1 has a toner inlet 4 that is able to be communicated with the toner outlet 23, and a step portion 5 engageable with the position-limiting hook 25. The other structural features of the image-forming cartridge 1 may be modified. For example, the lower slider 7 may be omitted, and the image-forming cartridge 1 may be provided with no abutment portion 6.

Based on the above-mentioned technical features, various modifications to the structure of the toner cartridge 10 may be made. For example, the upper slider 30 or the seal member 40 may be replaced by other structure that can seal the toner outlet 23. Further, the positions of the guiding portion 27 and the guiding groove 34 can be exchanged with each other. The resilient arm 33 and the guiding portion 27 may be modified with other structures as long as the resilient arm 33 can be guided by the guiding portion 27 to change its position.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner cartridge for being connected with an image-forming cartridge of an electronic image-forming apparatus, the image-forming cartridge comprising a toner inlet and a step portion located by the toner inlet, the toner cartridge comprising:

a housing having an internal accommodation for storage of toners, a toner outlet communicated with the internal accommodation and an outside of the housing, and a position-limiting hook located by the toner outlet;

wherein when the toner cartridge is connected with the image-forming cartridge, the position-limiting hook is engaged with the step portion such that the toner outlet is communicated with the toner inlet.

2. The toner cartridge as claimed in claim 1, wherein the step portion of the image-forming cartridge includes a step surface facing downwardly; the toner outlet of the housing is provided at a bottom side of the housing, and the position-limiting hook includes a hook surface facing upwardly; when the toner cartridge is connected with the image-forming cartridge, the hook surface is abutted against the step surface.

3. The toner cartridge as claimed in claim 2, further comprising an upper slider moveably disposed on the housing in a way that the upper slider is moveable relative to the housing between a closed position where the upper slider seals the toner outlet and an open position where the upper slider does not seal the toner outlet.

4. The toner cartridge as claimed in claim 3, wherein the upper slider is provided with an resilient arm having a terminal end; the housing includes a guiding portion in contact with the resilient arm; when the upper slider is moved from the closed position to the open position, the resilient arm is guided by the guiding portion in a way that the terminal end of the resilient arm is moved from an initial position to an engagement position.

5. The toner cartridge as claimed in claim 4, wherein the engagement position of the terminal end of the resilient arm is located below the initial position of the terminal end of the resilient arm.

6. The toner cartridge as claimed in claim 4, wherein the resilient arm comprises a guiding groove into which the guiding portion extends.

7. The toner cartridge as claimed in claim 4, wherein the image-forming cartridge comprises an abutment portion; when the toner cartridge is moved from the image-forming cartridge along a dismantlement direction, the terminal end of the resilient arm is located at the engagement position and abutted against the abutment portion to enable that the upper slider is moved relative to the housing from the open position to the closed position.

8. The toner cartridge as claimed in claim 3, wherein the image-forming cartridge comprises a first stop portion; the upper slider has a second stop portion; when the toner cartridge is moved along an installation direction to connect the image-forming cartridge, the second stop portion is abutted against the first stop portion and the upper slider is moved relative to the housing from the closed position to the open position.

9. The toner cartridge as claimed in claim 3, wherein the upper slider comprises an opening; when the upper slider is located at the open position, the opening of the upper slider is aimed at the toner outlet of the housing.

10. The toner cartridge as claimed in claim 3, further comprising a seal member disposed between the upper slider and the housing.

11. The toner cartridge as claimed in claim 1, further comprising an upper slider moveably disposed on the housing in a way that the upper slider is moveable relative to the housing between a closed position where the upper slider seals the toner outlet and an open position where the upper slider does not seal the toner outlet.

* * * * *